US010093502B2

(12) United States Patent
Deckert

(10) Patent No.: US 10,093,502 B2
(45) Date of Patent: Oct. 9, 2018

(54) CUTTING APPARATUS AND SPLICING APPARATUS

(71) Applicant: KHS GmbH, Dortmund (DE)

(72) Inventor: Lutz Deckert, Haltern am See (DE)

(73) Assignee: KHS GMBH, Dortmund (DE)

( * ) Notice: Subject to any disclaimer, the term of this patent is extended or adjusted under 35 U.S.C. 154(b) by 236 days.

(21) Appl. No.: 15/021,818

(22) PCT Filed: Aug. 4, 2014

(86) PCT No.: PCT/EP2014/066744
§ 371 (c)(1),
(2) Date: Mar. 14, 2016

(87) PCT Pub. No.: WO2015/036174
PCT Pub. Date: Mar. 19, 2015

(65) Prior Publication Data

US 2016/0221783 A1 Aug. 4, 2016

(30) Foreign Application Priority Data

Sep. 12, 2013 (DE) ..... 10 2013 110 039

(51) Int. Cl.
*B65H 19/18* (2006.01)
*B65H 19/20* (2006.01)

(52) U.S. Cl.
CPC ..... *B65H 19/18* (2013.01); *B65H 19/20* (2013.01); *B65H 2301/41524* (2013.01); *B65H 2301/46014* (2013.01); *B65H 2402/54* (2013.01); *B65H 2511/514* (2013.01); *B65H 2701/1313* (2013.01); *B65H 2801/75* (2013.01)

(58) Field of Classification Search
CPC ..... B65H 19/18; B65H 2301/46014; B65H 2801/75
See application file for complete search history.

(56) References Cited

U.S. PATENT DOCUMENTS

| | | | | |
|---|---|---|---|---|
| 2,249,669 A | | 7/1941 | Thornton | |
| 3,197,152 A | | 7/1965 | Antoni et al. | |
| 3,326,485 A | | 6/1967 | Huck | |
| 4,157,934 A | * | 6/1979 | Ryan | B65H 19/1852 156/504 |
| 4,455,190 A | * | 6/1984 | Bianchetto | B65H 19/1852 156/504 |
| 5,468,321 A | * | 11/1995 | van Liempt | B65H 19/1852 156/157 |
| 5,650,036 A | * | 7/1997 | Sato | B65H 19/1852 156/159 |

(Continued)

FOREIGN PATENT DOCUMENTS

| | | |
|---|---|---|
| DE | 44 33 207 | 3/1996 |
| EP | 0 802 139 | 10/1997 |

(Continued)

*Primary Examiner* — Sang K Kim
(74) *Attorney, Agent, or Firm* — Occhiuti & Rohlicek LLP

(57) ABSTRACT

A label cutter comprises a movable cutting blade, a pre-tensioning device, and a trigger. The pre-tensioning device pre-tensions the cutting blade into an arrested position. Upon its release, the cutting blade moves from the arrested position to a cutting position for cutting a label strip. In the arrested position, the cutting blade is retracted behind a component of the cutter.

16 Claims, 4 Drawing Sheets

(56) References Cited

U.S. PATENT DOCUMENTS

| | | | | |
|---|---|---|---|---|
| 8,088,238 | B2 * | 1/2012 | Hafner ..... | B65H 19/102<br>156/159 |
| 2007/0113984 | A1 | 5/2007 | Pasqualoni | |

FOREIGN PATENT DOCUMENTS

| | | |
|---|---|---|
| FR | 1 499 595 | 10/1967 |
| WO | 2007/009585 | 1/2007 |

* cited by examiner

CUTTING APPARATUS AND SPLICING APPARATUS

RELATED APPLICATIONS

This application is the national stage under 35 USC 371 of PCT/EP2014/066744, filed on Aug. 4, 2014, which claims the benefit of the Sep. 12, 2013 priority date of German application DE 102013110039.2, the content of which is herein incorporated by reference.

FIELD OF INVENTION

The present invention relates to a cutting apparatus and a splicer of the kind needed for labeling machines, especially for roll-feed or self-adhesive applications whose labels are provided as an endless strip on a roll.

BACKGROUND

In packaging operations, it is often necessary to apply labels. These labels are often on a strip. Although a great many labels are on a strip, eventually one comes to the last label. At that point, a new strip must be provided.

At one time, the packaging machine had to be shut down while a new label strip was inserted. However, modern packaging machines include labeling machines that permit one to change labels in a way that ensures that the labeling operation is continuous. In a labeling machine of this type, the end of a depleted endless strip is typically attached to the start of a new endless strip to enable the label strips to be changed without interrupting the labeling operation. This is done using a splicing machine.

A splicing machine typically includes a pressing element that presses the two parallel label strips together when they are to be spliced. These splicing machines also have a cutter that off the old strip end. A disadvantage of known implementations of this solution is their complexity as well as the hazard associated with the cutter.

SUMMARY

It is the object of the present invention therefore to provide a cutting apparatus for label strips and a splicer for label strips which are safe to use without excessive complexity.

According to the invention, the cutting apparatus of a splicer for a label strip comprises at least one movable cutting element that is pre-tensioned in an arresting position by a pre-tensioning device. The cutting apparatus also comprises a trigger mechanism for releasing the pre-tensioning device so as to move the cutting element from the arrested position into a cutting position where it cuts off the associated label strip. When, in the arrested position, the cutting element, conventionally a cutting blade, is retracted behind at least one component of the cutting apparatus. This component can comprise, for example, non-moving frame parts or housing parts, in particular a housing panel. The latter conceals the cutting element in the arrested position so that the cutting element is not so exposed that personnel can injure themselves on it when changing the strip. In this way the cutting element is positioned so as to eliminate the risk of injury when the strip is changed.

The pre-tensioning device preferably includes something that pre-tensions the cutting element in its arrested position. Examples include an elastic element, or a spring, such as a coil spring. When the trigger mechanism releases the pre-tensioning device, the cutting element snaps into the cutting position and cuts through the label strip.

Advantageously, the deployment movement of the cutting element is no longer brought about by a pneumatic drive as was previously customary, but by the relaxation of the pre-tensioned element, in particular of a compression spring preferably configured as a coil spring. The energy for the cutting operation is therefore derived from release of stored mechanical energy. The source of stored mechanical energy can be a spring element made from spring steel as, for example, a coil spring or spiral spring, disk spring or rubber element or the like. It is only necessary for the elastic element to be able to store the energy needed to displace the cutting element from the arrested position to the cutting position so that the cutting operation can be executed at a desired speed.

For this reason it is possible to dispense completely with pneumatic elements to control the cutting of the label strips. This reduces cost. The invention therefore provides a more occupationally safe and cheaper solution for cutting label strips in a splicer.

The pre-tensioning device preferably comprises a tensioning piece for manually pre-tensioning the pre-tensioning device. After the cutting element has cut through a label strip it must be returned from its cutting position to the arrested position against the force of the pre-tensioning device. A tensioning piece, for example a tensioning lever, is simply suited to this purpose and requires no additional pneumatic or electric drives.

The pre-tensioning device preferably comprises at least one spring, in particular a coil spring. The energy required to move the cutting element into the cutting position can be applied very simply by this means. In this case the pre-tensioning device preferably comprises a releasable detent device for pre-tensioning the spring. The detent device is then released by the trigger mechanism to allow the spring to push the cutting element into its cutting position. One end of the spring is preferably connected to the cutting element or to a carrier of the cutting element for this purpose.

The component behind which the cutting element retracts to the arrested position is preferably a wall of the cutting apparatus. In this way the cutting element is effectively protected from inadvertent contact, and the entire splicer is safer.

In this case, the wall preferably comprises a slit through which the cutting blade advances to the cutting position. The accessible region of the cutting element in the wall is therefore limited solely to the slit, which the cutting element needs so as to advance into its cutting position. It is virtually impossible for someone to injure themselves on the cutting element through the slit. This embodiment is therefore very safe while allowing the cutting apparatus to operate reliably.

The trigger mechanism is preferably electromagnetically operable so that it can be activated by the controller of the splicer, for example on the basis of a signal from an end-of-strip sensor. The label strip is therefore cut off simply and automatically.

The invention relates in particular to a splicer for label strips that comprises at least one frame and/or housing in which conveyor paths are arranged for two label strips. The conveyor paths contain first guide rolls and a first cutting apparatus of the above-mentioned type for a first label strip and second guide rolls and a second cutting apparatus of the above-mentioned type for the second label strip. The splicer also contains a splicing station for joining the two label strips. The invention is therefore intended in particular for a splicer that incorporates two of the cutting apparatuses described above. The aforesaid advantages apply analogously to the inventive splicer.

The first cutting apparatus is preferably mounted with at least a first part of the splicer on a first swivel arm and the second cutting apparatus with at least a second part of the splicer on a second swivel arm; the swivel arms are mounted so as to be able to swivel on the frame or housing of the splicer between an operating position and an open position. The first and second parts of the splicer can each be formed, for example, by one half of the splicing station and comprise deflector rolls and/or anvil rolls of the splicer, which are used to join together the two label strips in the region of their strip end. The cutting apparatus is arranged in such a way that, when the swivel arms are in the operating position, the cutting elements are concealed by the parts of the splicer. In particular, if the elements of one half of the splicer are arranged on the swivel arm, the corresponding half of the splicer can be easily opened for a strip change while the label strip can run on in the other half of the splicer.

A tensioning piece used to manually pretension the pre-tensioning device and which is preferably configured as a tensioning lever that can be accessed from the outside is preferably arranged in conjunction with the pre-tensioning device of each cutting apparatus. Preferably, the tensioning piece can be used to release the swivel arm from the operating position to the open position as well as to pretension the pre-tensioning device when a label strip end has been cut off. The advantage of this is that actuating the tensioning piece ensures that the cutting element is retracted to its arrested position first and only then is the swivel arm opened into the open position. This arrangement prevents the cutting element from causing any injury, something which would be quite possible if the swivel arm could be opened in the open position before the cutting element has retracted back into its arrested position as the pre-tensioning device is being pre-tensioned. It is an advantage that the pre-tensioning device can be pre-tensioned and that the corresponding half of the splicer can be opened for a change of strip at the same time in a single maneuver, simplifying the strip change and making it safer.

In a further advantageous embodiment of the invention, an electrical switch interrupts the supply of power to the trigger mechanism of the cutting apparatus when the swivel arm is moved from its operating position to the open position. This switch is provided in conjunction with the swivel arm. Such a switch can be a basic contact switch that is only closed when the swivel arm is in the operating position. The risk of injuries due to an accidental actuation of the trigger mechanism when a new strip is loaded is effectively prevented in this way. The safety of the splicer is thus once again significantly increased in this way.

In a further advantageous embodiment of the invention, the first and second part of the splicer are those of its components that must be accessible for loading a new label strip so that opening the swivel arms affords access to all of these components of the splicer.

The splicer preferably comprises at least one sensor for detecting the end of a label strip. A central controller of the splicer can therefore use a signal from this sensor to control both the splicing station and the cutting apparatuses in such a way that the strip end of a running strip is cut off cleanly and joined to the start of a new label strip with an accurate fit.

The splicer preferably comprises a splicing station having two halves associated with the two label strips so as to make it easy to work at the corresponding splicing-station half when the label strip is being changed. Preferably, the conveyor paths and the cutting apparatuses of two halves of a splicing station that are each associated with one label strip are then configured mirror-symmetrically for both label strips. This reduces the number of components and hence reduces production costs.

If one half of the splicer or parts of it are open through the opening of a swivel arm, an operator can prepare the next splicing operation in complete safety by, for example, loading a new label strip and inserting the start of the new label strip in the splicer in the correct position. When the operator closes the newly prepared half again, the interactive connection between the machine controller and the electromagnetically operated trigger mechanism is restored by the electrical contact with the result that the machine controller can initiate the cutting operation at the correct time.

The inventive cutting and splicing apparatus offers the overall advantage that the movement of the cutting element, e.g. the cutting blade, is effected far more rapidly than it would have been using a pneumatic version. This guarantees safe and accurate splicing at high or even very high track speeds. Splicing at a high or very high track speed is a major advantage, especially when a labeling machine is disposed immediately downstream, i.e. without an intermediate container buffer, of a stretch-blow machine because a slowing-down or actual stopping of the stretch-blow machine in order to splice a label strip can be reduced in frequency or even avoided altogether in this way.

The electrical connection to the trigger mechanism is interrupted when the swivel arm is open, thus preventing an inadvertent extension of the cutting blade. The inventive solution gives value for money, saves space and in extreme cases dispenses entirely with the use of pneumatics.

In one aspect, the invention features an apparatus for use in a labeling machine. Such an apparatus includes a first cutter having a movable cutting blade, a pre-tensioning device that pre-tensions the cutting blade into an arrested position, and a trigger releases the pre-tensioning device so that the cutting blade moves from the arrested position to a cutting position for cutting a label strip. When in the arrested position, the cutting blade is retracted behind a component of the cutter.

In some embodiments, the pre-tensioning device includes a tensioning piece for manually pre-tensioning the pre-tensioning device. In others, it includes an elastic material. And in yet other embodiments, it includes a spring.

In those embodiments that include a spring, the pre-tensioning device also includes a releasable detent device for a pre-tensioned position of the spring, those in which a first end of the spring connects to a cutting blade, and those in which the spring's first end connects to a blade carrier.

In some embodiments, the component of the cutter behind which the cutting blade is retracted includes an inner protective wall that faces a course of a label strip. Among these are embodiments that further include a slit formed in the inner protective wall, the slit being configured such that the cutting blade advances through the slit into a cutting position.

In other embodiments the trigger includes an electromagnetically operated trigger.

Additional embodiments include a second cutter identical to the first cutter, first and second guide rolls, and a splicing station. Each combination of a cutter and a guide rule defines a conveyor path for one of the two label strips. Meanwhile, a splicing station joins the first and second label strips. In some of these embodiments, the splicing station includes first and second halves, each of which accommodates one of the two label strips. In these embodiments, the two halves, the cutters, and the conveyor paths are all mirror images of each other. Also among these embodiments are those that include a sensor configured to detect an end of a label strip.

Some embodiments include those in which first and second deflector rolls are on corresponding first and second swivel arms, each of which between an open position and an operating position. Among these are embodiments in which a tensioning lever causes the swivel arm to transition from the operating position to the open position, in addition to permitting manual pre-tensioning of the pre-tensioning device. Also among these embodiments are those in which an electrical contact element interrupts a supply of power to the trigger when the swivel arm opens, and those in which the deflector rolls include components that must be accessed to change a label strip.

BRIEF DESCRIPTION OF THE DRAWINGS

The invention is described below by way of example by reference to the schematic drawing in which.

DETAILED DESCRIPTION

Figure 1:
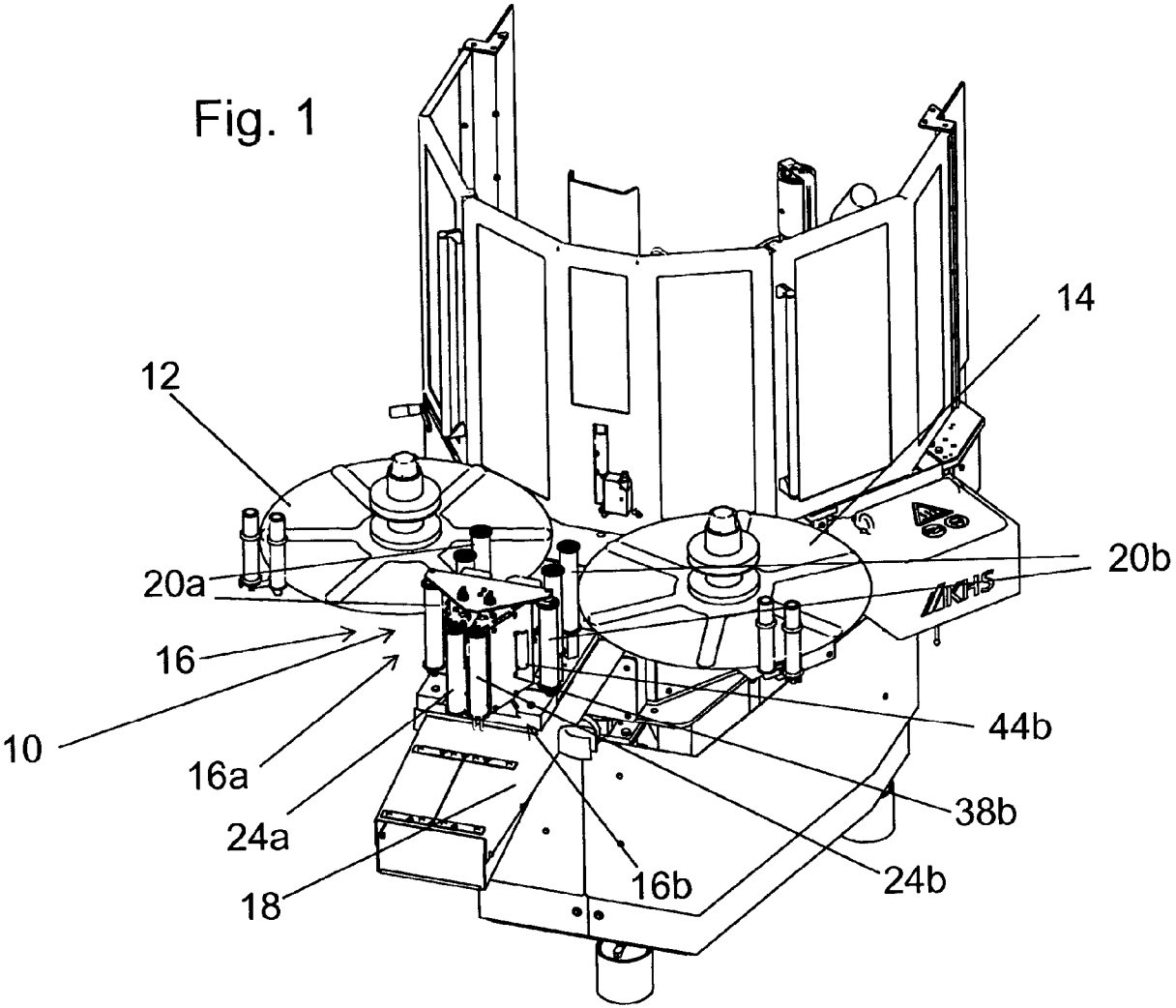
FIG. 1 shows a perspective view of a labeling station comprising an inventive splicer.

FIG. 1 shows a splicer 10 that includes first and second retaining plates 12, 14 for label strips and a splicing station 16 consisting of two splicing-station halves 16*a*, 16*b* that are mirror images of each other.

Figure 3:
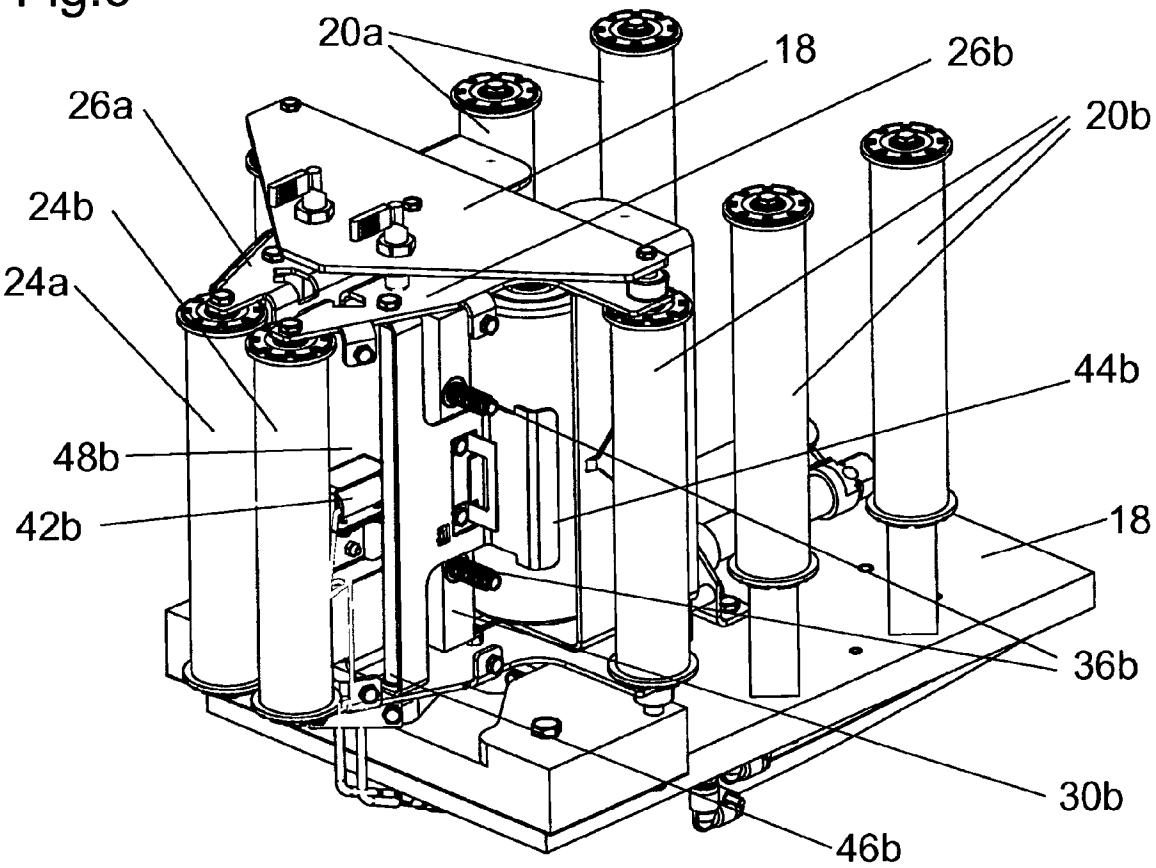
FIG. 3 shows a perspective view of a part of the splicer of FIG. 1; a side panel has been omitted in order to show the pre-tensioning mechanism.

The two mirror-symmetric splicing-station halves 16*a*, 16*b* have first and second guide rolls 20*a*, 20*b*, first and second cutters 22*a*, 22*b*, best seen in FIG. 3, and first and second deflector rolls 24*a*, 24*b* for joining the label strips. The first cutter 22*a* and the first deflector roll 24*a* are held on a first swivel arm 26*a* of the splicing station 16. The second cutter 22*b* and the second deflector roll 24*b* are held on a second swivel arm 26*b* of the splicing station 16. The swivel arms 26*a*, 26*b* are, in turn, held on the frame 18 of the splicer 10.

Figure 2:
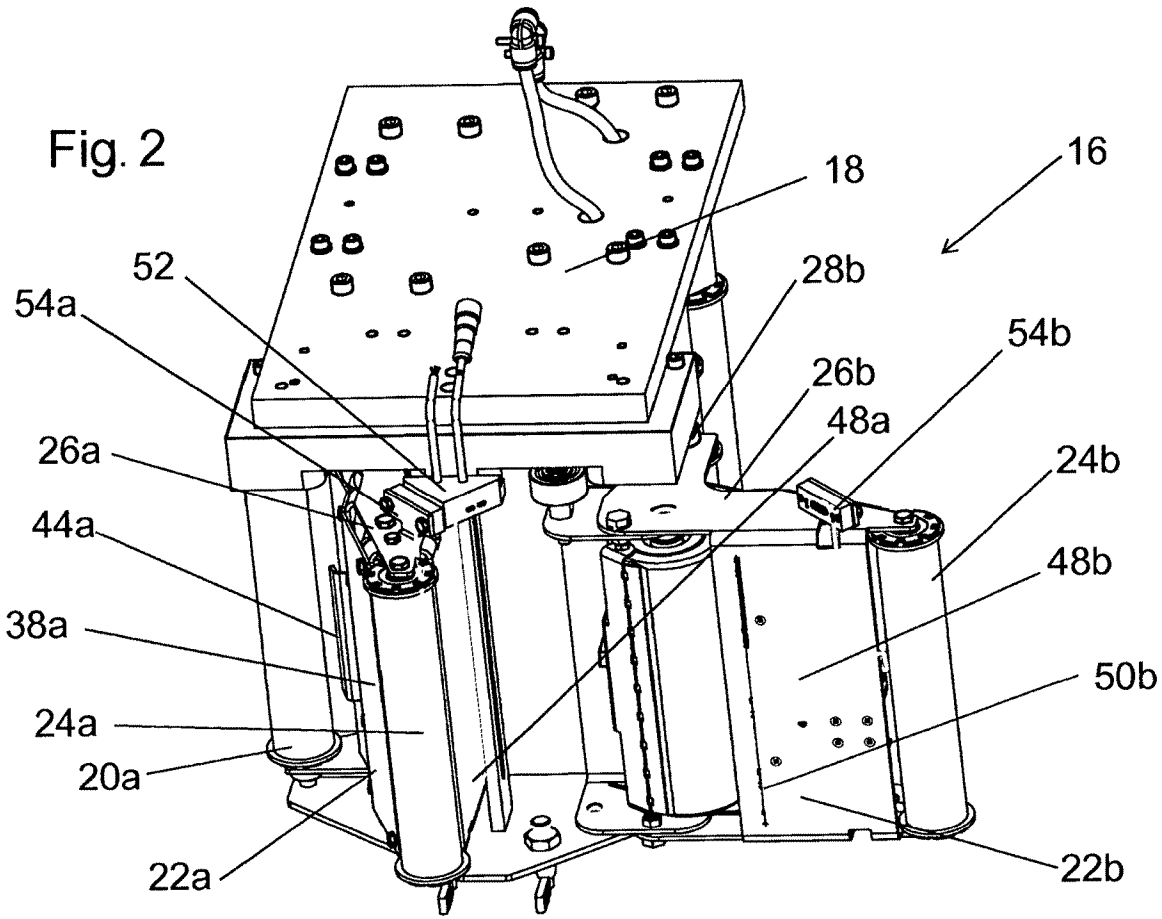
FIG. 2 shows a perspective view of a detail of the splicer of FIG. 1 with an additional break contact.

Each swivel arm 26*a*, 26*b* transitions between an open position and an operating position. In the open position, it is possible to change the label strip. In the operating position, the splicer 10 is in actual use. The left-hand side of FIG. 2 shows the first swivel arm 26*a* in its operating position; the right-hand side of FIG. 2 shows the second swivel arm 26*b* in its open position. First and second swivel bearings 28*a*, 28*b* hold the first and second swivel arms 26*a*, 26*b* on the frame 18 of the splicer 10.

Figure 4:
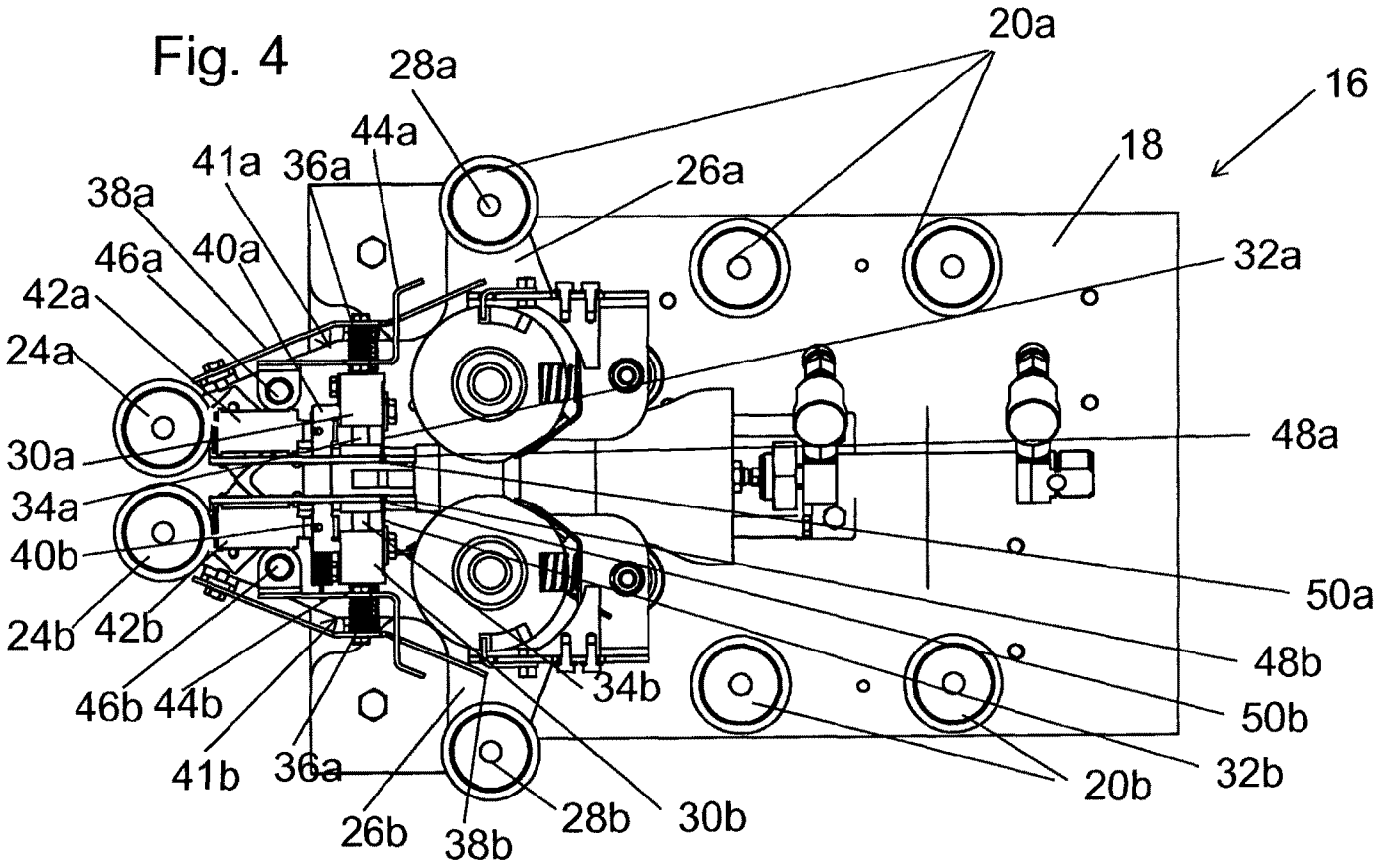
FIG. 4 shows an enlarged plan view of a part of the splicer shown in FIG. 1.

As can be seen from FIG. 3 and FIG. 4, each cutter 22*a*, 22*b* has a blade carrier 30*a*, 30*b* that holds a cutting blade 32*a*, 32*b*. The blade carrier 30*a*, 30*b* is movably guided on a guide 34*a*, 34*b* at right angles to the course of the label strip. Each blade carrier 30*a*, 30*b* is held on a first end of a coil spring 36*a*, 36*b* or lies against a coil spring 36*a*, 36*b*. A second end of the coil spring 36*a*, 36*b* attaches either to an outer wall 38*a*, 38*b* of the splicing station 16 or to another component that is connected to frame 18.

The cutter 22*a*, 22*b* also comprises a detent 40*a*, 40*b* that can arrest the blade carrier 30*a*, 30*b* in a pre-tensioned position of the coil spring 36*a*, 36*b*. An electromagnetically-operated trigger 42*a*, 42*b* releases the detent 40*a*, 40*b*. The coil spring 36*a*, 36*b*, the blade carrier 30*a*, 30*b*, and the detent 40*a*, 40*b* collectively form a pre-tensioning device 41*a*, 41*b*, as shown in FIG. 4.

Finally, FIG. 4 shows a tensioning lever 44*a*, 44*b* that projects beyond an outer wall 38*a*, 38*b* of each symmetrical splicing-station half 16*a*, 16*b*. The tensioning lever 44*a*, 44*b* is mounted so as to be able to swivel on a swivel axis 46*a*, 46*b* on the frame 18. Using this tensioning lever 44*a*, 44*b*, the blade carrier 30*a,b* can be pre-tensioned from a cutting position into an arrested position.

In addition to pre-tensioning the cutting blade 32*a*, 32*b* in the arrested position, operating the tensioning lever 44*a*, 44*b* also draws the swivel lever 26*a*, 26*b* from its operating position to its open position.

Referring now to FIG. 2, Each symmetrical splicing-station half 16*a*, 16*b* has an inner protective wall 48*a*, 48*b* that faces the course of the label strip. A slit 50*a*, 50*b* in the inner protective wall 48*a*, 48*b* permits passage of the cutting blade 32*a*, 32*b*. When the swivel arm 26*b* is in its the open position, an operator can change a label strip in the corresponding half 16*b* of the splicing station 16 without the risk of being injured by the cutting blade 32*b*.

A frame-mounted contact element 52 interacts with associated arm-mounted contact elements 54*a*, 54*b* on corresponding swivel arms 26*a*, 26*b*. It is via these associated arm-mounted contact elements 54*a*, 54*b* that the trigger 42*a* of the splicing-station half 16*a*, 16*b* receives current. Therefore, it is not possible to trigger the cutter 22*a*, 22*b* to transfer of cutting blade 32*a*, 32*b* from the arrested position to the cutting position as long as the swivel arm 26*a*, 26*b* remains open.

An advantage of the splicing station 16 described herein is that the single maneuver of operating the tensioning lever 44*a*, 44*b* carries out two functions. First, it pretensions the pre-tensioning device 41*a*, 41*b* thus retracting the cutting blade 32*a*, 32*b* into its protected arrested position. At the same time, it swings the corresponding swivel arm 26*a*, 26*b* into its open position to allow the strip to be changed in the corresponding splicing-station half 16*a*, 16*b*. While the swivel arm 26*a*, 26*b* is in the open position, an operator can quickly load a new label strip in the prescribed feed position without fear of injury from the cutting blade 32*a*, 32*b*.

Yet another advantage of the splicing station 16 is that both the cutting blade 32*a*, 32*b* and the trigger 42*a*, 42*b* can be actuated entirely without pneumatic components. In particular, the manually pre-tensioned coil spring 36*a*, 36*b* provides the energy for actuating the cutting blade 32*a*, 32*b*, and electric current provides the energy needed to operate the trigger 42*a*, 42*b*.

The splicer 10 therefore allows the label strip to be changed quickly and safely.

In the depicted embodiment, when swivel arms 26*a*, 26*b* are in their operating position the tensioning lever is connected with a detent for the swivel arms such that when the tensioning lever 44*a*, 44*b* is actuated, the detent of the associated swivel arm is released and the swivel arm can be opened, as shown on the δright-hand side of FIG. 2.

In some embodiments, a controller electrically interrogates the contacts determines whether they are closed. If the contacts are closed, the controller concludes that the halves 16*a*, 16*b* of the splicing station 16 are in the operating position. By verifying the switched state of the contacts, it is possible to ensure that the splicer is fully closed and that the splicing station 16 is fully prepared for the next splicing operation.

Having described the invention, and a preferred embodiment thereof, what is claimed as new, and secured by Letters Patent is:

1. An apparatus for use in a labeling machine, said apparatus comprising a first cutter, wherein said cutter comprises a movable cutting blade, a pre-tensioning device, and a trigger, wherein said pre-tensioning device pre-tensions said cutting blade into an arrested position, wherein said trigger releases said pre-tensioning device so that said cutting blade moves from said arrested position to a cutting position for cutting a label strip, wherein, when in said arrested position, said cutting blade is retracted behind a component of said cutter, and wherein said pre-tensioning device comprises a tensioning piece for manually pre-tensioning said pre-tensioning device.

2. The apparatus of claim 1, wherein said pre-tensioning device comprises an elastic material.

3. The apparatus of claim 1, wherein said pre-tensioning device comprises a spring.

4. The apparatus of claim 3, wherein said pre-tensioning device comprises a releasable detent device for a pre-tensioned position of said spring.

5. The apparatus of claim 3, wherein said spring comprises a first end that connects to said cutting blade.

6. The apparatus of claim 3, wherein said spring comprises a first end that connects to a blade carrier.

7. The apparatus of claim 1, wherein said component of said cutter behind which said cutting blade is retracted comprises an inner protective wall that faces a course of a label strip.

8. The apparatus of claim 7, further comprising a slit formed in said inner protective wall, said slit being configured such that said cutting blade advances through said slit into a cutting position.

9. The apparatus of claim 1, wherein said trigger comprises an electromagnetically operated trigger.

10. The apparatus of claim 1, further comprising a second cutter identical to said first cutter, first and second guide rolls, and a splicing station, wherein said first guide roll and said first cutter define a first conveyor path for conveying a first label strip, wherein said second guide roll and said second cutter define a second conveyor path for conveying a second label strip, and wherein said splicing station is disposed to join said first and second label strips.

11. The apparatus of claim 10, wherein said trigger is configured to be activated based on a signal indicative of an end of a label strip.

12. The apparatus of claim 10, wherein said splicing station comprises first and second halves, each of which accommodates one of said two label strips, and wherein said first and second halves are mirror images of each other, wherein said first and second cutters are mirror images of each other, and wherein said first and second conveyor paths are mirror images of each other.

13. The apparatus of claim 10, further comprising first and second swivel arms and first and second deflector rolls, wherein each deflector roll is on a corresponding swivel arm, and wherein each swivel arm is configured to transition between an open position and an operating position.

14. The apparatus of claim 13, further comprising a tensioning lever that causes said swivel arm to transition from said operating position to said open position, and wherein said tensioning lever enables permits manual pre-tensioning of said pre-tensioning device.

15. The apparatus of claim 13, further comprising an electrical contact element that interrupts a supply of power to said trigger when said swivel arm transitions from said operating position to said open position.

16. The apparatus of any one of claim 13, wherein said first and second deflector rolls comprise components to which access is required for changing a label strip.

* * * * *